United States Patent [19]

Couste et al.

[11] Patent Number: 4,836,287

[45] Date of Patent: Jun. 6, 1989

[54] SAFETY GATE VALVE FOR PETROLEUM WELLS, PERMITTING OPERATION BY ARTIFICIAL FLOW

[75] Inventors: Eric Couste, Lons; Jean-Luc Jacob, Lescar, both of France

[73] Assignee: Merip Oil Tools International (MOTI) S.A., Toulouse, France

[21] Appl. No.: 109,356

[22] Filed: Oct. 15, 1987

[30] Foreign Application Priority Data

Oct. 16, 1986 [FR] France ..... 86 14503

[51] Int. Cl.[4] ..... E21B 34/10; E21B 23/04; E21B 43/00

[52] U.S. Cl. ..... 166/321; 166/68; 166/212; 166/237; 166/322; 166/372

[58] Field of Search ..... 166/68, 105, 372, 321, 166/322, 237, 212, 217

[56] References Cited

U.S. PATENT DOCUMENTS

| | | | |
|---|---|---|---|
| 4,474,234 | 10/1984 | Lefebvre et al. | 166/105 |
| 4,478,288 | 10/1984 | Bowyer | 166/322 X |
| 4,479,539 | 10/1984 | Tamplen et al. | 166/237 X |
| 4,480,697 | 11/1984 | Goldanigar | 166/322 X |
| 4,597,446 | 7/1986 | Helderle | 166/322 |
| 4,729,433 | 3/1988 | Jacob | 166/322 |
| 4,776,399 | 10/1988 | Jacob | 166/321 |

*Primary Examiner*—Hoang C. Dang
*Attorney, Agent, or Firm*—Harold H. Dutton, Jr.

[57] ABSTRACT

The invention relates to a safety valve for oil wells, able to permit artificial output operation by injection of a fluid under pressure. This valve comprises a movable closing flap (11), a tubular internal slide (9), a spring (10) for returning said slide to its upper position, a hydraulic system for displacing said slide downwardly due to pressure of a control fluid, an internal tube (300) for passage of injected fluid, fixed to the slide (9), a lower connecting sleeve of a series of lower tubes (Ti) for the passage of injected fluid, able to be connected with the internal tube (300) when the tube is in the lower position, an upper connecting sleeve (309) of a series of upper tubes for the passage of injected fluid, in which may slide in a sealed manner the internal tube, a system for anchoring the valve in a receiving sleeve (1) comprising a hydraulically actuated mechanical system controlled by the control fluid, and seals (15, 16) at the contact of the receiving sleeve (1).

13 Claims, 3 Drawing Sheets

SAFETY GATE VALVE FOR PETROLEUM WELLS, PERMITTING OPERATION BY ARTIFICIAL FLOW

Figure 1:
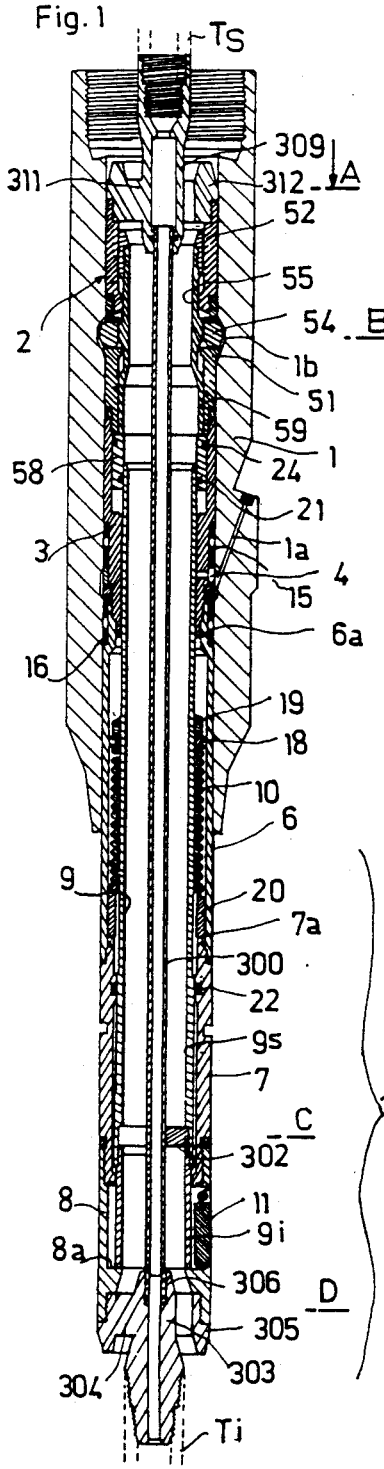

This invention relates to a safety valve intended to be inserted into a production tube of an oil well in order to assure the opening or closing thereof, while permitting an operation with artificial output by the injection of a fluid under pressure, termed the injected fluid.

Safety valves for oil wells have as their function to automatically stop the production effluent if an incident happens at the head of the well or downstream thereof. They are controlled hydraulically by opening from the surface and being closed automatically by means of a pressure return spring upon the occurrence of a drop of hydraulic pressure, controlled or accidental. These valves have been the object of numerous studies for development and improvement, and their use has become generalized in eruptive offshore wells.

At the time of their installation, these valves are anchored in a receiving sleeve secured in the production tube; the anchorage is established by means of a system of mechanical dogs capable of undergoing a radial displacement which causes them to enter into an anchoring groove in the receiving sleeve: these dogs are then locked in their anchoring position by a spring which forces a locking sleeve to the interior of said dogs. When these dogs are correctly positioned and locked, they provide a locking which benefits from good qualities of mechanical resistance. However, the operation of such a locking or anchoring system is a laborious operation carried out blindly at the interior of the wells and is never coupled with an assurance of good success, the operator having no way of for knowing if the valve is correctly anchored and locked in the receiving sleeve.

Additionally, when the pressure of the effluents becomes to low in a well, it is necessary to inject a fluid under pressure, generally a gas, through a series of tubes passing to the center of the production tube, which injection serves to unload the effluent column. The known valves are not adapted to this injection, particularly for the reason that the anchoring dogs and their locking system too great a radial obstruction to permit the passage of an internal injection tube of a sufficient diameter.

French patent No. 2,536,783 and its certificate of addition 2,555,246 and corresponding U.S. Pat. No. 4,597,446 disclose a valve of a structure modified with respect to traditional valves; in this new valve, the locking is achieved by means of an elastic sleeve which is maintained radially retracted by a system of a collar and keys during the descent of the valve, and which is relaxed at the end of the descent when the sleeve reaches the level of the anchoring groove in the receiving sleeve. This system permits placement of an internal gas injection tube, but has the very serious drawback of being extremely fragile: the elastic ring breaks very often either during placement of the valve or during its unlocking, and each rupture brings about very serious practical difficulties of repair and significant risks for the personnel. Moreover, as in the case of the traditional systems, the placement is carried out blindly, without any assurance of correct anchoring.

The present invention proposes to provide an improved safety valve, capable of permitting an operation during artificial output, without presenting the defects indicated above for known valves.

An object of the invention is in particular to furnish a valve for artificial output wells, benefitting from a very strong anchoring system permitting assurance of correct anchoring upon placement.

Another object is to permit unlocking and easy removal of the valve, without risk of rupture.

Another object is to provide a valve for artificial wells which benefits from the majority of the advantages of the improved valves for eruptive wells described in French patent applications Nos. 86.11417 and 86.11418 filed by the same applicant on July 29, 1986 and their corresponding U.S. Pat. Nos. 4,776,399 and 4,729,433.

Another object is to permit an easy transformation of the valves in order to adapt them to the types of wells concerned: artificial output wells or eruptive wells.

In order to facilitate understanding, the valve in accordance with the invention is described assuming that it is in place in an oil well, the terms "top," bottom," "upper," "lower," "base," "head" . . . referring to this position in the well.

The safety valve provided by the invention is intended to be inserted in the production tube of an oil well in order to assure the opening or the closing thereof, while permitting an operation under artificial output by injection of a fluid under pressure, termed the "injected fluid"; according to the invention, the valve comprises in combination:

- a generally tubular valve body,
- a movable closing flap valve, situated in the lower part of said body and urged toward its closed position,
- a tubular slide adapted to be able to slide longitudinally in the interior of the valve body in order to cause, by its downward movement, the opening of the closing flap,
- a return spring arranged in an annular groove situated between the slide and the valve body, in such a manner as to urge the slide toward a top position corresponding to the closing of the closing flap,
- means for hydraulically displacing said slide toward the bottom, comprising a control fluid inlet through the valve body and a sealed volume between the slide and the body intended to receive the control fluid, the slide having a difference of cross-section subjected to the fluid pressure contained in said sealed volume in such a manner as to undergo a downward force when said volume is under pressure,
- upper and lower seals or packings arranged around the valve body in order to assure a seal at the interface between the valve body and the receiving sleeve equipping the production tube, at levels situated above and below the inlet of the control fluid,
- an internal tube for the passage of injected fluid, of a diameter less that that of the tubular slide and secured on the interior thereof, said internal tube being fixed to the slide by securing means and having a lower connection extremity situated above the closing flap when the slide is in the top position and below the closing flap when the slide is in the bottom position,
- a lower anchoring sleeve fixed to the bottom of the valve body and adapted to permit the fixing of the lower injected fluid passage tubes, the lower anchoring sleeve having an upper extremity conjugate the lower connection extremity of the internal tube in such a manner as to permit sealingly connecting these extremities while permitting their release by a displacement thereof in a separating direction, an upper anchoring sleeve, fixed at the head of the valve body and adapted to permit the fixing of the upper injected fluid passage tubes, said upper anchoring sleeve having an internal bore adapted to permit a sealed sliding of the upper extremity of the internal tube, a mechanical anchoring system for hydraulic actuation, situated in the upper part of the valve body below the upper anchoring sleeve and adapted to permit fixing the valve body in the receiving sleeve lodged in the production tube, said system comprising stop means for the valve body in the receiving sleeve, radially movable dogs for being able to penetrate, in the stop position, into an anchoring groove in the receiving sleeve, and mechanical means for operating and locking said dogs, able to be subjected to control fluid pressure in the mentioned sealed volume and adapted to force the dogs back radially and lock them in the anchoring groove under the effect of said pressure.

According to a preferred embodiment, the operating and locking means comprise:

a tubular shuttle piston, slidingly mounted so as to be freely displaced in the valve body around the upper part of the slide, between a bottom stop position and a top stop position in the absence of any mechanical blocking at the height of its displacement, the shuttle piston being adapted to present a surface subjected to the pressure of the control fluid contained in the sealed volume in such a manner as to undergo an upward force when the volume is under pressure, an equi-pressure locking bushing, slidingly mounted in the valve body above the shuttle piston but independently thereof in such a manner that the shuttle piston may only exert an upward pushing force on the bushing, without the possibility of carrying said bushing downwardly, said bushing having a peripheral cam adapted to come into correspondence with the dogs and repel them radially in the top position of the shuttle piston.

Thus, the valve in accordance with the invention comprises an improved anchoring system of the type of that provided in the valve disclosed in French patent application No. 86.11418, which is combined with an adaptation of the structure of said valve to permit the injection of a fluid under pressure in order to unload the column of effluent and permit an operation under artificial output. The dogs comprise strong mechanical pieces, not subjected to risks of rupture or breakage, however the hydraulic control system for their locking (by the intervention of a control fluid acting on the shuttle piston) presents only a slight radial obstruction permitting a freeing of the internal volume of the valve and mounting there the internal tube for the passage of the injected fluid, while preserving between this tube and the slide an annular space sufficient for the passage of the effluent. This internal tube is carried by the slide and follows the displacements thereof; at the upper part, it slides in a sealed manner in the upper anchoring sleeve such that the continuity of the injected fluid passage is permanently assured at this level; at the bottom part, the tube may either come to connect in a sealed manner with the lower anchoring sleeve for assuring the continuity of the injected fluid passage when the slide is in the bottom position (the closing flap is open), or be moved toward the top to permit the closing of the closing flap when the slide is in the top position (valve closed).

The valve according to the invention is thus able to assure, for an artificial output well, the same safeties as the valve for eruptive wells described in the application mentionned above; moreover, the invention benefits from various advantages of that valve: reduced risks of corrosion and of sediment deposits, guaranty of satisfactory anchoring . . . .

According to another characteristic of the invention, the valve body comprises several tubular pieces screwed one into the extension of the others by right hand threads and comprising, in the upper part, a screw body comprising two tubular pieces screwed one into the extension of the other by left hand threads: the lower piece contains the dogs and is screwed onto the adjacent lower portion of the valve body (by right hand threads), while the upper piece is provided in the top part with a head for fixing the upper anchoring sleeve.

As will be better explained hereinafter, such a valve may be extracted from well by carrying out a very simple unlocking and releasing procedure: it is sufficient to unscrew the two pieces of the body of the screw (by an appropriate rotation of the upper series of tubes) and withdrawing the assembly by pulling on the series of tubes.

Further, the valve structure preferably conforms to that described in French patent application No. 86.11417. In particular, the seals or packings situated on opposite sides of the control fluid inlet are advantageously positioned immediately below and above the fluid inlet, the anchoring system being situated above the upper seal, while the return spring is positioned below the lower seal in an annular groove formed by a part of the sealed volume intended to receive the control fluid.

Such a structure permits a complete purging of the sealed volume containing the control fluid when placed under pressure, while the provision of the return spring assures a total immersion thereof in the control fluid. This spring is positioned to be protected from the deleterious effects of the effluent or of corrosive gasses, and may be made of a steel of a high modulus of elasticity favorable to obtaining a high return force, stable with temperature.

Figure 2:
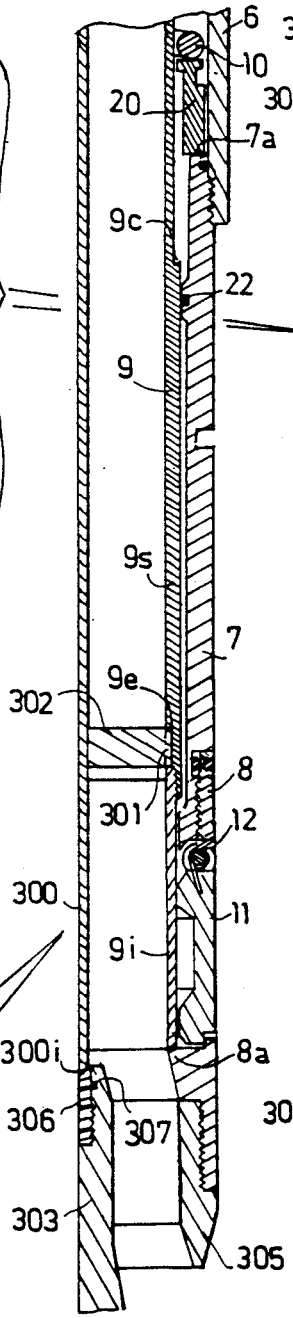
Figure 3:
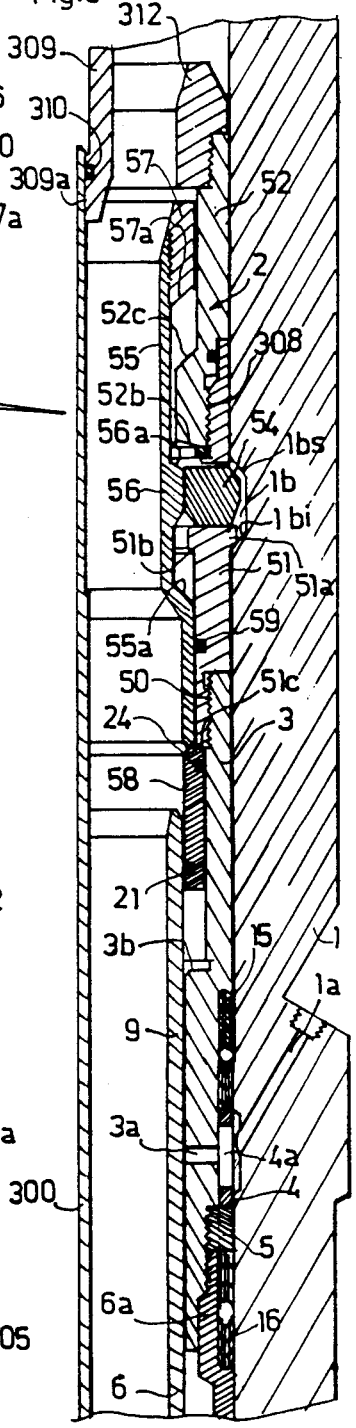
Figure 4:
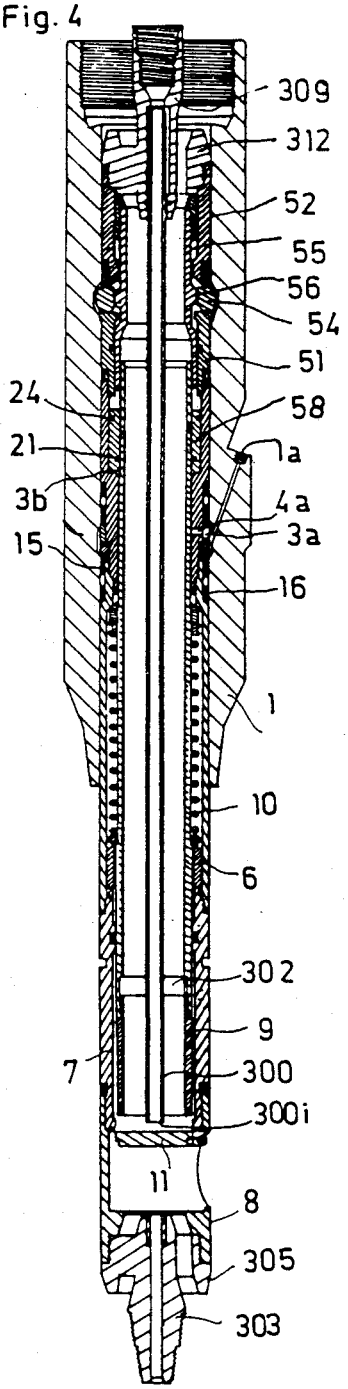
Figure 9:
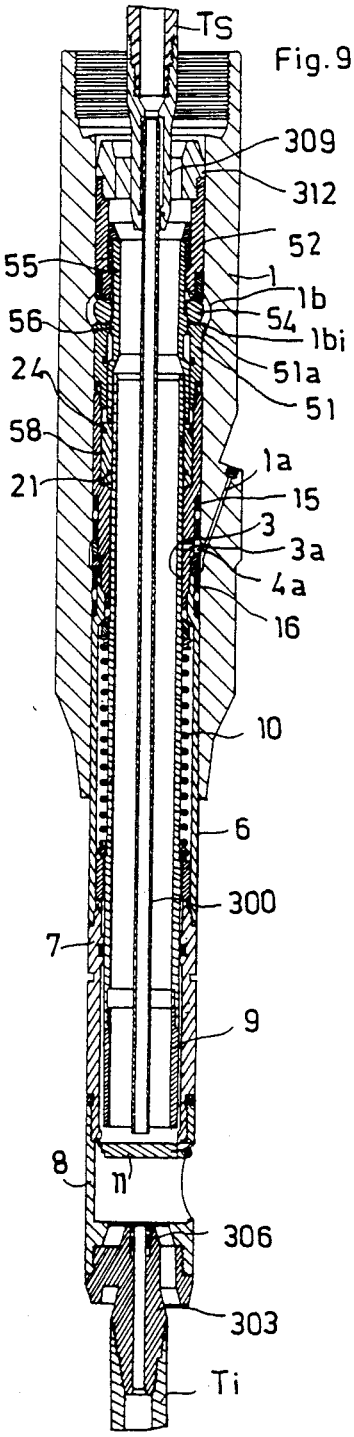
Figure 10:
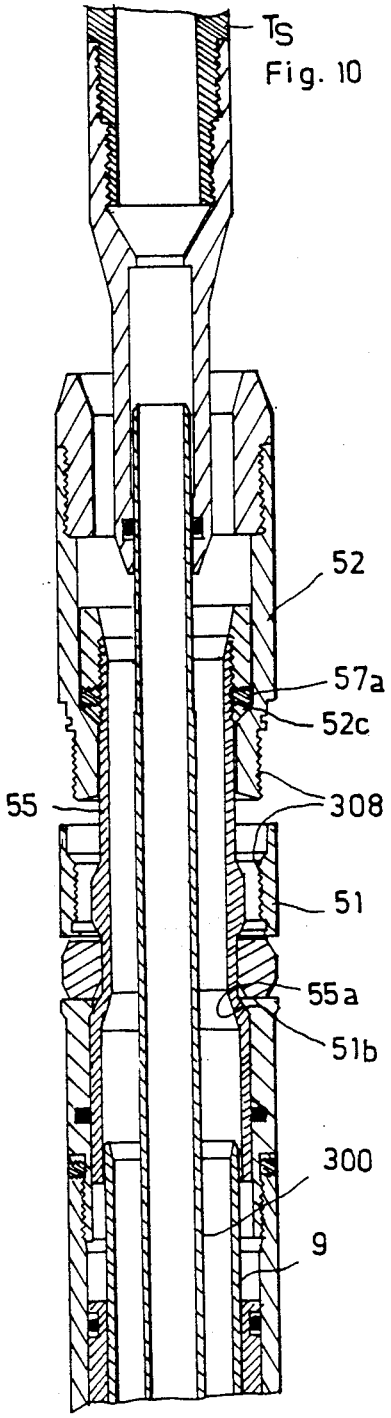

Other characteristics, objects and advantages of the invention will become apparent from the description which follows with reference to the accompanying drawings, which describe the invention by way of non-limiting examples of a preferred embodiment; in the drawings which form an integral part of the present description:

FIG. 1 is an axial cross sectional view along a vertical plane of a valve according to the invention, in the open position, anchored in its receiving sleeve, FIGS. 2 and 3 are partial detailed sections of said valve (respectively bottom part and top part thereof), FIG. 4 is an axial cross sectional view analogous to FIG. 1, the valve being in the closed position, FIGS. 5, 6, 7 and 8 are transverse cross sectional views of said valve respectively along planes A, B, C, and D, FIG. 9 is an axial section illustrating the operation of the anchoring of the valve (said valve being shown in a pre-anchoring position, the, anchoring and the locking being at the point of being hydraulically controlled), Finally, FIG. 10 is a partial axial cross section illustrating the unanchoring and extraction of the valve.

The safety valve shown by way of example in the drawings is intended to be fitted into a production tube of an oil well called upon to work in artificial flow due to an injection of gas under pressure. In a traditional manner, the production tube is provided with a receiving sleeve 1 provided with a control fluid inlet line 1*a* and an anchoring groove 1*b* the edges of which are in the form of conical ramps (lower conical face 1*bi* and upper conical 1*bs*).

The valve advantageously has the general structure of the improved valve described in French patent application No. 86.11417 filed by the present applicant; it comprises a valve body of a generally tubular form comprising several tubular pieces fixed one to the other: upper threaded body 2, upper joint holder 3 having an upper sealing member 15, tubular cross piece 4, blocking screw-ring 5, spring passageway 6 having an upper projection 6*a* carrying a lower seal 16, lower sleeve 7, closer body 8. The joint 3 and the cross member 4 are traversed by openings 3*a*, 4*a* for the passage of control fluid coming from line 1*a*. The seals, upper 15 and lower 16, are positioned immediately above and below the opening 4*a*. The various tubular pieces forming the valve body are fixed by screwing one into the extension of the others by means of right hand threads.

At the interior of the valve body, is mounted a tubular slide 9 able to be displaced longitudinally in the valve body, between a bottom position (corresponding to opening) shown in FIG. 1 and a top position (corresponding to closing) shown in FIG. 4. This slide is retracted to its top position by a return spring 10 which is mounted, below the packings 15 and 16, in an annular sealed volume defined by the external face of the slide 9 and the internal face of the skirt 6. The spring 10 extends between an upper support comprising a screw-ring 19 screwed around the slide 9 (with interposition of an auxiliary bushing 18 having the same function as the bushing 18 of the valve described in application No. 86.11421), a lower bushing 20 slidingly mounted around said slide. A lower stop 9*c* limits the travel at the bottom of the bushing with respect to the slide (this stop 9*c* is formed by a shoulder provided on the external surface of the slide). In addition, in the bottom position with respect to the valve body, this bushing 20 comes to be applied against a shoulder 7*a* provided on the interior of the valve body (the shoulder formed by the upper edge of the sleeve 7 screwed into the spring skirt 6).

These arrangements permit removing the valve without risk of damaging the return spring 10, since it remains in place around the slide between the upper support 19 and the lower bushing 20 which comes into contact against the shoulder 9*c* of the slide.

This slide is hydraulically controlled at the bottom by control fluid arriving through line 1*a* when the latter is placed under pressure. This control fluid is formed of a lubricant liquid; when placed under pressure, it passes through the openings 4*a* and 3*a*, arrives at the interface of the valve body and the receiving sleeve by the seals 15 and 16 situated on opposite sides of the openings and comes to fill the sealed volume situated between the slide and the valve body.

This sealed volume is limited at the interface of the slide/valve body:

first by an upper sealing joint 21 arranged above the inlet of the control fluid in a groove of a shuttle piston 58 which forms part of the anchoring system described below (a complimentary joint 24 being provided on the external surface of the shuttle piston for assuring the seal at the interface thereof with the valve), and secondly, by a lower sealing joint 22 disposed in a groove below and adjacent the lower extremity of the return spring 10, under pressure against the slide.

The slide 9 presents, at the level of the lower joint 22, a greater section than that existing at the level of the upper joint 21 in such a manner that the control fluid under pressure acts towards the bottom on the slide by the action of the difference in cross section.

It should be emphasized that at the time of pressurizing the control fluid line, the return spring 10 is completely immersed in the liquid lubricant and isolated from the effluent; moreover, the configuration of the sealed volume containing the control fluid permits a purge of this volume which keeps this spring from all corrosive contact with gas.

At the bottom part, the closer body 8 comprises a moveable closing member comprising a flap 11 which is articulated on the body in such a manner as to be able to pivot between an open position retracted on the side (FIG. 1) and a closed position wherein the flap closes the valve body while applying against a sealing joint carried thereby (FIG. 4). The flap 11 is retracted to the closure position by a spring 12 disposed around its axis of articulation. It should be noted that this closing member may be of the type described in French patent application No. 86.11421 filed by the applicant.

Under the effect of the hydraulic control, the slide 9 is displaced towards its bottom position so as to come into contact with a shoulder 8*a* of the closing member 11 and hold it in the open position. When the control fluid pressure accidentally drops or momentarily drops, the return spring 11 causes a displacement of the slide upwardly, to its top position where it retracts in the sleeve 7 (FIG. 4). The closing member 11 is thus freed and recloses under the action of its own spring 12.

The slide 9 carries an internal concentric tube 300 for the passage of a gas under pressure which is injected in order to raise the column of effluent and produce an artificial flow.

For this purpose, the slide 9 is formed of two threaded portions one following the other: an upper portion 9*e* extending over the greatest part of the height and a lower portion 9*i* (FIG. 2); the upper portion 9*e* carries at its lower part a groove 9*e* which is formed by the lower portion 9*i* when it is threaded into the end of the upper portion.

This groove 9*a* may thus contain and retain a ring 301 which is seen on the transverse section 7. This ring, concentric with the slide 9 and tube 300 is fixed on the peripheral extremities of radial lugs 302, in the example three in number, spaced around the internal tube 300; the central extremities of these lugs are fixed by soldering to the tube 300. In the lower part, each lug 302 extends by a tip shaped in such a manner as to reduce the loss of pressure and turbulence which they cause in the effluent, which is caused to flow from the bottom to the top in the annular space formed between the internal tube 300 and the slide 9.

The internal tube. 300 is thus displaced with the slide 9 which carries the tube 300, between the bottom position (opening position shown in FIG. 1) and a top position (closing position shown in FIG. 4). Its length is provided such that in the bottom position, its lower extremity termed the connection 300*i* is situated slightly below the level of the closing flap 11 and in its top position, this lower extremity connection pivots above at the level of the flap.

In the bottom position, said lower connection extremity 300*i* comes into coupling with a lower coupling sleeve 303 the purpose of which is to assure the retention of a lower series of tubes (shown at Ti in dotted lines in FIG. 1) in the interior of which passes the injected gas. For this purpose, the lower coupling sleeve 303 is provided at its lower portion with a right hand thread, around which is screwed the last tube Ti of the lower series.

The coupling sleeve 303 is fixed to the base of the valve body on the closure body 8, due to the radial arms 304, in the example three in number (FIG. 8), which are positioned around said sleeve and thus the peripheral extremities are solidly secured to an annular base 305 forming the nose of the valve.

In the example, this piece 305 is screwed onto the closer body (by a right hand thread). If needed, it may be made of a single piece with this body (the assembly of body 8/piece 305/arm 304/sleeve 303 being formed by a single piece from a foundry).

The lower coupling sleeve 303 is equipped at its upper extremity with a conical bearing surface shown at 306, provided on a short portion of the threaded tube in the sleeve 303 with inner position of a seal 307. This portion of the tube is formed of a synthetic such as a polyamid, capable of assuring a seal upon contact of the internal tube 300 when the latter is found in the bottom position; the lower extremity connection 300*i* of said internal tube is cut to a conjugate conical shape as the surface 306 in order to obtain a sealed connection.

At the top part, the valve is provided with a mechanical anchoring system which is hydraulically actuated, which comprises essentially the lock body 2, the anchoring dogs 54, a lock bushing 55 and a shuttle piston 58.

The lock body is threaded by a right hand thread 50 on the contiguous portion of the valve body (formed by the upper joint 3). Its bottom extremity 51*c* forms internally a projection serving as a stop for the shuttle piston 58 in the top position This lock body is composed of two tubular pieces, lower 51 and upper 52, which are threaded in the extension one into the other by left hand threads 308. These threads which are of opposite pitch to those of the other threads of the valve permit by a right hand rotation freeing the two pieces 51 and 52 in order to withdraw the valve, as will be seen below.

Figure 6:
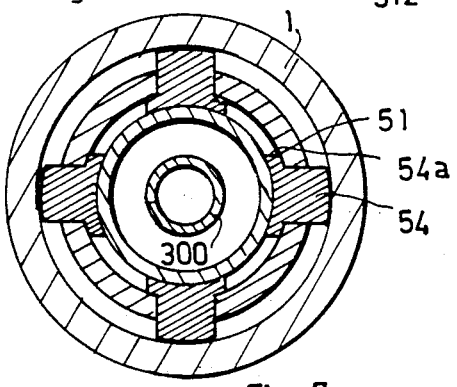
Figure 7:
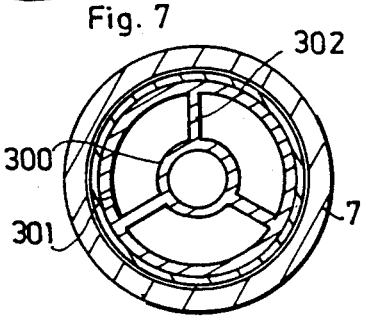
Figure 8:
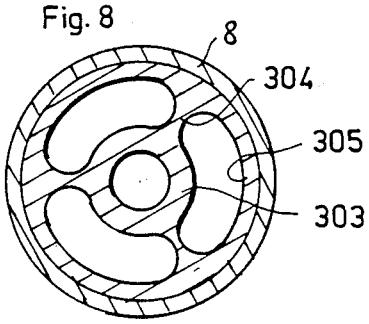

The lower piece 51 is provided with floating dogs such as 54, which are mounted in guide openings therein. In the example shown in FIG. 6, these dogs are four in number, spaced around the piece. Each dog formed by die is a compact mechanical piece, without risk of fracture, and having upper and lower external chamfers, and internal lower chamfers, in such a manner as to be able to move radially when the locking bushing 55 or the receiving sleeve 1 comes into contact against one of the chamfers. Further, the shoulders 54*a* provided laterally on the interior of each dog, prohibit complete escape toward the outside of each dog when coming into contact against the piece 51 of the lock body. Each dog may thus be caused to project from the lock body as shown in FIGS. 1 and 6 (anchoring position) or on the contrary retracted therein (as shown in FIGS. 9 or 10).

The lower piece 51 of the lock body comprises a stop shoulder 51*a*, which is situated below and in the proximity of the dogs 54. This shoulder has the form of a conical ramp oriented toward the bottom, in such a manner as to come into contact with the lower conical face 1*bi* of the anchoring groove 1*b* when the valve moves downwardly in the receiving sleeve 1. The lock body presents, above this shoulder 51*a*, a diameter slightly greater than below the shoulder, the bore of the receiving sleeve 1 having a conjugate form. Thus, when put into place, the descent of the valve in the production tube is stopped when its shoulder 51*a* comes into contact with the lower face 1*bi* of the anchoring groove, the dogs 54 then being found opposite said groove.

Further, the lower piece 51 of the locking body is interiorally provided below the level of the dogs with an anchoring shoulder 51*b* presenting the form of a conical ramp oriented toward the bottom. As will be seen below, this shoulder permits anchoring of the locking bushing 55 to the piece 51 in the case of separation by unscrewing the pieces 51 and 52.

The upper piece 52 comprises equally an internal face 52*b* which presents the form of a conical ramp oriented toward the bottom, adapted to serve as an extreme stop of the lock bushing 55.

The upper piece 52 comprises finally an internal shoulder 52*c* which has the form of a conical ramp oriented toward the top, in order to permit an anchoring of said upper piece 52 on the lock bushing 55 after unscrewing the pieces 51 and 52.

The radial displacement of the dogs 54 toward their anchoring position and the locking thereof in this position are assured by the locking bushing 55 already described, this bushing being displaced longitudinally for this purpose by the shuttle piston 58.

The locking bushing 55 in equal pressure is mounted slidingly in the lock body with interposition of a locking joint 59 at the interface of the bushing/lower piece 51; the bushing is independent of the shuttle piston 58 which may only exert thereon a upward pressure. The locking bushing 55 has a peripheral cam 56 which is adapted to radially move the dogs 54 toward the exterior when they arrive at the level thereof.

This cam 56 has an upper face 56*a* which has the form of a conical ramp an upwardly directed, in such a manner as to be able to retract the dogs 54 upon contact therewith. Further, the upper face. 56*a* limits the travel of the bushing 55 when contacting the internal face 52*b* of the upper piece 52.

The locking bushing 55 is also provided with an anchoring shoulder 55*a*, situated below the level of its cam 56 and conjugate with the anchoring shoulder 51*b* of the piece 51 in such a manner as to be able to cooperate therewith after unscrewing of the pieces 51 and 52 and withdraw toward the top of the cam 56 with respect to the dogs 54: the piece 51 is found thus connected to the bushing 55.

Further, the lock bushing 55 is exteriorally provided at its top portion with a peripheral connection 57, comprising in the example a threaded ring therearound. This ring has a lower conical face 57*a*, adapted to be able to come into contact with the internal shoulder 52*c* of the upper piece 52 of the lock body, in order to realize a connection of said upper piece on said bushing after unscrewing the pieces 51 and 52.

The shuttle piston which is used for displacing the lock bushing 55 toward the top anchoring position is formed by a tubular portion adapted to be able to freely slide in a sealed manner between the valve body (top part of the joint) and the upper extremity of the slide 9).

This shuttle piston 58 is provided with sealing joints already described, internal 21 at the slide/shuttle piston interface, and external 24 at the shuttle piston/valve body interface; these joints which limit in the top portion the sealed volume containing the control fluid are of different diameters in such a manner as to define the surface by which the shuttle piston is subjected to the pressure of the control fluid in order to bring about its displacement toward the top. It should be noted that the shuttle piston 58 is free to slide under the effect of the hydraulic pressure in the absence of any mechanical blockage.

Thus, in the valve according to the invention, the control fluid acts in the first place on the shuttle piston 58 for tending to displace toward the top from a bottom position or being found in contact against the shoulder 3*b* of the joint 3 (FIG. 4) toward a top position where the shuttle piston comes into contact against the projection 51*c* which forms the lower extremity of the piece 51 (FIGS. 1 and 3). During the course of its displacement, the shuttle position pushes the locking bushing 55 bringing the cam 56 in order to radially maneuver the dogs 54 and lock them.

Further, the control fluid acts upon the slide 9 to tend to displace it toward the bottom, from its top closing position (FIG. 4) where the screw ring 19 comes into upper contact with the flange 6*a* of the skirt of the spring 6, toward a bottom open position (FIG. 1) where the slide comes into contact against the shoulder 8*a* of the closure body 8.

The internal tube 300 which permits injection of gas under pressure penetrates in the top part into the anchoring sleeve or upper connecting sleeve 309 which has a bore 309*a* provided with a seal 310, sized to permit a sealingly sliding of the upper extremity of said internal tube 300. The length of the tube 300 is such that its upper extremity remains permanently sealingly engaged in this bore regardless of the position to or bottom.

At the top part, the sleeve is threaded to the right to permit screwing it onto the first tube Ts of an upper series of tubes (discontinuous threads in FIG. 1).

Figure 5:
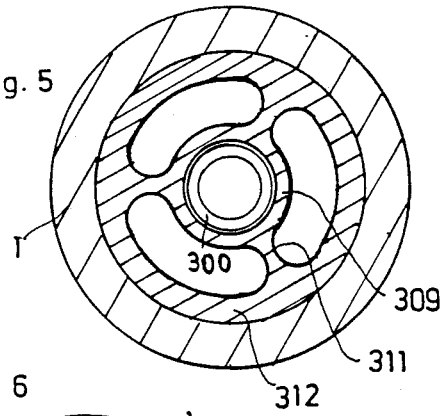

The upper connecting sleeve 309 is fixed to the head of the valve body, on the upper piece 52 of the lock body, by radial arms 311, in the example three in number, spaced around said sleeve (FIG. 5). The peripheral extremity of these arms is solidly fastened an annular fixation head 312 screwed by right hand threads onto the upper piece 52.

The structure of the valve according to the invention having been described in detail, there will now be described the procedures for installing and removing the same.

The placing and anchoring of the valve are carried out in the following manner (FIG. 9).

The valve being free of pressure, its slide 9 is found in the top position by the action of the return spring 10; the internal tube 300 solidly attached to the slide 9 is itself found in the top position. The flap 11 is closed. Further, the shuttle piston 58 and the locking bushing 55 are in the bottom position, the dogs 54 being free to be cleared.

A series of lower tubes Ti the length of which may be up to 3,000 m is first lowered into the well in a conventional manner by means of conventional machine tools. The valve is screwed on by its lower attaching sleeve 303 to the upper extremity of the lower series of tubes; then the upper anchoring sleeve 309 is screwed on to the lower extremity of another series of tubes Ts and the assembly is lowered by means of conventional machine tools. The series of upper tubes Ts generally has a length on the order of 100 to 150 m.

The valve penetrates into the receiving sleeve 1 of the production tube of the well; the force for engaging the packings 15 and 16 is overcome by the weight of the lower series of tubes (several tons). The dogs 54 of the valve which are floating, withdraw at the entrance to the receiving sleeve.

The engagement in the receiving sleeve follows until the valve is stopped by the stop shoulder 1*bi* of the receiving sleeve against which comes into contact the stop shoulder 51*a* thereof (FIG. 9).

The control circuit is then pressurized; the oil enters in the sealed volume previously described and the pressure rises. The shuttle piston 58 of the valve is subjected to an upward force and rises while pushing the lock bushing 55 to its top position. During its displacement, the bushing radially moves the dogs 54 and locks them on the interior of the anchoring groove 1*b*. At the point, the valve is anchored in the position shown in FIG. 4 (with the exception of the shuttle piston which is found in the top position).

The oil pressure continues to rise until it overcomes the force of the return spring 10: the slide 9 is then displaced toward the bottom and the closing member 11 is forced to the open position (FIG. 1).

The internal tube 300 descends with the slide 9 and, at the end of the downward travel, comes to cooperate with the conical surface 306 of the lower anchoring sleeve 303, while in the top part, the upper extremity of said internal tube slid in the upper anchoring sleeve 309 remaining sealingly engaged therein.

The valve is open and the continuity of the injected fluid circuit is assured.

To verify whether the valve is correctly anchored, it is sufficient to exert upon the upper tubes Ts a pulling force greater than the weight of the assembly; the dogs 54, if they are correctly anchored and locked, come into contact against the upper face lbs of the anchoring groove. The assembly is then impossible to remove: a measuring apparatus then permits verification of the complete absence of movement while the exerted force is much higher than the weight of the series of tubes and the valve.

In the event of poor anchoring, the assembly will rise in the well and the default may be detected at the surface. The valve of the invention thus offers the ability to assure, upon each installation, that the anchoring has been correctly obtained or a poor anchoring has resulted from many causes: deterioration of the 0-ring seals 15 and 16 during descent or deterioration of the receiving sleeve at the level of said seals (preventing placing the control fluid under pressure), deposits due to the effluent in the anchoring groove 1*b*, (preventing outward movement of the dogs 54).

Further, the valve once correctly anchored in the oil well may be closed in a conventional manner by an intended or accidental purge of the hydraulic control line and stopping of the injected gas. It then comes into the position of FIG. 4. The return spring 10 has caused an upward displacement of the slide 9 and of the internal tube 300 to which it is connected, freeing the closing member 11 which closes under the action of its own spring 12 assisted by the pressure of the well (pressurized by the gas already injected).

Once the valve closes, the well no longer flows, but the pressures are equalized above and below the member 11 while the production tube is not purged in its upper portion. The pressure which prevails in this latter acts upon the shuttle piston 58 which again descends to its bottom position; however, the bushing 55 remains in place due to the hardness of the locking joint 59.

When the upper portion of the production tube is purged, the pressure upstream of the well is applied to the complete section of the valve; the dogs 54 of the valve then come to be applied against the upper conical face 1*bs* of the anchoring groove 1*b*, which conditions a locking effect of the bushing 55 the moreso the pressure of the well is raised: the valve benefits from a self-locking proportional to the pressure of the well.

The reopening of the valve is achieved, first by injecting into the upper tubes Ts and internal tube 300 the gas under pressure in order to establish equilibrium of the pressure on opposite sides of the flap, then by placing anew under pressure the hydraulic control line: the shuttle piston 58 returns against the bushing 55 and against its stop 51*c* and the opening results as previously explained by displacement of the slide 9 and the internal tube 300 downwardly under the pressure of the control fluid.

The un-anchoring and re-mounting of the valve according to the invention are achieved in the following manner (FIG. 10)

The hydraulic control line being purged and the injection of gas stopped, the well is then placed in security, that is, with impossibility of flow (due to a previous equilibrium by pumping water). The upper series of tubes is then caused to turn to the right by standard keys in such a manner as to unscrew the right hand threads 308 which connect the upper piece 52 of the lock body and the lower piece 51. When these two pieces are disconnected, one is assured that a pulling on the upper series of tubes, which has the effect of bringing the shoulder 52*c* of the upper piece into contact with the shoulder 57*a* of the lock bushing 55.

As a result, this lock bushing 55 rises again until its shoulder 55*a* comes into contact against the shoulder 51*b* of the lower piece of the lock body. The dogs 54 are then freed and may move toward the interior: subsequent pulling causes withdrawal of the valve until dislocation of the packings 15 and 16 is achieved, the valve then being able to be removed to the surface.

We claim:

1. A safety valve for insertion into a production tube of an oil well for assuring the opening or closing thereof, while permitting an operation with the artificial output by a fluid injected under pressure, said valve comprising in combination:

a generally tubular valve body, a movable closing flap (11) in the lower part of said body and urged toward its closed position, a tubular slide (9) longitudinally slidable in the interior of the valve body for causing by its descending movement the opening of the closing flap, a return spring (10) disposed in an annular groove between the slide and the valve body so as to urge said slide toward an upper position for closing of said closing flap, means for hydraulically displacing said side downwardly comprising a control fluid inlet (3*a*, 4*a*) across said valve body and a sealed volume between the slide and the body for receiving the control fluid, said slide having a difference in cross-section subjected to the fluid pressure contained in said sealed volume in such a manner as to undergo a downward force when said volume is under pressure, lower (16) and upper (15) seals disposed around the valve body for assuring a seal at the interface between said valve body and a receiving sleeve (1) in the production tube below and above the control fluid inlet, an internal tube (300) for passage of injected fluid and having a diameter less than that of the tubular slide (9) and mounted in the interior thereof, said internal tube being fixed to the slide by fixing means (301, 302), and having a lower extremity connection (300*i*) and a length such that said lower extremity connection is positioned above the closing flap (11) when the slide is in the upper position and below said closing flap when said slide is in the lower position, a lower anchoring sleeve (303) fixed to the bottom of the valve body and including lower injected fluid passage tubes (ti), said lower anchoring sleeve having an upper extremity connection (306 connected to the lower extremity connection (300*i*) of the internal tube in such a manner as to permit a selected connection of said upper and lower extremities connection while permitting their release upon displacement thereof in the direction of their separation, an upper anchoring sleeve (309) in the upper portion of the valve body and including upper injected fluid passage tubes (Ts), said upper anchoring sleeve having an internal bore (309*a*) enabling a sealed sliding of the upper extremity of the internal tube (300) therein, a hydraulically actuated mechanical locking system, in the upper portion of the valve body, below the upper anchoring sleeve (309) for securing the valve body in the receiving sleeve (1), said system comprising valve body stop means (1*bi*, 51*a*) in said receiving sleeve, radially moveable dogs (54) mounted in said valve body for movement between a retracted position and an extended position penetrating into an anchoring groove in the receiving sleeve above said stop means, and mechanical dog actuating and locking means slidably mounted in said valve body and responsive to the pressure of control fluid contained in said sealed volume for radially moving and locking said dogs in the anchoring groove under the effect of said pressure, a tubular shuttle piston (58) slidingly mounted so as to be freely displaceable in the valve body around the upper portion of said slide (9), between a lower stop position and an upper stop position, said shuttle piston having a surface subjected to the pressure of the control fluid in the sealed volume in such manner as to undergo an upward force when said sealed volume is under pressure, a slide bushing (55) in equal pressure slidingly mounted in the valve body above said shuttle piston (58) and independent thereof in such a manner that said shuttle piston may only exert an upward pressure on said bushing with no possibility of carrying the same downwardly, said bushing having a peripheral cam (56) adapted to engage said dogs (54) and hold said dogs in their extended position when the shuttle piston is in its upper stop position.

2. A safety valve as in claim 1, and wherein the sealed volume is limited in the upper part of the valve by a first seal (24) at the interface between the shuttle piston and the valve body and by a second seal (21) of a lesser diameter situated at the interface between the slide and the shuttle piston, the difference in diameter of said seals defining the surface of the shuttle piston upon which the control fluid acts.

3. A safety valve as in claim 2 and wherein:

the valve body includes in the upper portion a tubular lock body screwed onto a lower contiguous portion (3) of said valve body, the shuttle piston (58) being slidingly mounted in said lower contiguous portion (3), the bottom extremity (51*c*) of the lock body forming a stop projection for the shuttle piston in the upper position, the slide bushing (55) being slidingly mounted in the lock body in such manner as to be able to move against the upper extremity of the shuttle piston (58).

4. A safety valve as in claim 3 and wherein:

the valve body comprises a plurality of tubular pieces (3, 6, 7, 8,) threaded one onto the end of the next by right hand threads, the lock body comprising tow tubular pieces (51, 52) screwed one onto the end of the other by left hand threads, the lowermost piece (51) containing the dogs (54) and being screwed onto the lower contiguous portion (3) of the valve body by right hand threads, while the uppermost piece (52) is connected to the lower end of a fixing head (312) for said upper anchoring sleeve (309).

5. A safety valve as in claim 4 and wherein:

the lock body having a first stop shoulder (51*b*) adjacent a second stop shoulder (55*a*) on the bushing (55), said stop shoulders (55*a*, 51*b*) cooperating upon upward disengagement of the cam (56) with respect to the dogs (54) for achieving an abutment of the lower piece (51) on the bushing (55).

6. A safety valve as in claim 5 an wherein the slide bushing (55) includes a peripheral abutment (57), for contacting an internal shoulder (52*c*) in the upper piece (52) of the lock body, for achieving a connecting of said upper piece on said bushing after unscrewing this upper piece with respect to the lower piece (51) of the lock body.

7. A safety valve as in claim 6 and wherein the upper piece (52) of the lock body includes an internal face (52*b*) adapted to serve as an extreme stop to an upper face (56*a*) of the cam (56) of the slide bushing (55).

8. A safety valve as in claim 21 and wherein the fixing means for the internal tube (300) in the slide (9) comprises a plurality of radial lugs (302) spaced around said internal tube and fixed thereon, a concentric ring (301) around said internal tube fixed upon the peripheral extremities of said lugs, and a groove (9*e*) arranged in the slide (9) for containing and retaining said ring.

9. A safety valve as in claim 8 and wherein the lower anchoring sleeve (303) has at is upper extremity a conical bearing surface (306) of a material able to assure a seal upon contact with the internal tube (300), said internal tube having a lower connection extremity (300*i*) having complementary conical shape.

10. A safety valve as in claim 9 and wherein the lower anchoring sleeve (303) is fixed to the lower end of the valve body by radial arms (304) spaced around said sleeve, the peripheral extremity of said arms being fixed to an annular base (305) forming a portion of the valve body.

11. A safety valve as in claim 10 and wherein the upper anchoring sleeve (309) is fixed to the valve body by radial arms (311) spaced around said sleeve, the peripheral extremity of said arms being fixed to an annular fixation head (312) screwed onto the upper piece (52) of the lock body, the internal bore (309*a*) of said upper anchoring abutment sleeve being provided with a sealing joint (310) and sized to permit the sliding of the upper extremity of the internal tube (300).

12. A safety valve as in claim 11 and wherein the seals (15, 16) situated on opposite sides of the control fluid inlet (3*a*, 4*a*) are positioned immediately below and above the control fluid inlet and the return spring (10) being positioned below the lower seal (16) in an annular groove comprising a portion of the sealed volume for receiving the control fluid.

13. A safety valve as in claim 12, and wherein the return spring (10) extends between an upper support (19) fixed to the slide and a lower bushing (20) slidingly mounted around said slide a lower stop (9*c*) for limiting the downward travel thereof with respect to said slide, said lower bushing contacting a shoulder (7*a*) on the interior of the valve body.

* * * * *